US006925837B2

(12) United States Patent
Eaton

(10) Patent No.: US 6,925,837 B2
(45) Date of Patent: Aug. 9, 2005

(54) ENHANCED OPERATION OF LNG FACILITY EQUIPPED WITH REFLUXED HEAVIES REMOVAL COLUMN

(75) Inventor: Anthony P. Eaton, Sugar Land, TX (US)

(73) Assignee: ConocoPhillips Company, Houston, TX (US)

( * ) Notice: Subject to any disclaimer, the term of this patent is extended or adjusted under 35 U.S.C. 154(b) by 9 days.

(21) Appl. No.: 10/696,010

(22) Filed: Oct. 28, 2003

(65) Prior Publication Data

US 2005/0086976 A1 Apr. 28, 2005

(51) Int. Cl.[7] ..... F25J 3/00; F25J 1/00
(52) U.S. Cl. ..... 62/612; 62/628; 62/623
(58) Field of Search ..... 62/612, 628, 620, 62/623, 613

(56) References Cited

U.S. PATENT DOCUMENTS

| | | | | |
|---|---|---|---|---|
| 4,040,806 | A * | 8/1977 | Kennedy | 62/621 |
| 4,445,916 | A | 5/1984 | Newton | |
| 5,325,673 | A | 7/1994 | Durr et al. | |
| 5,615,561 | A * | 4/1997 | Houshmand et al. | 62/611 |
| 6,112,549 | A | 9/2000 | Yao et al. | |
| 6,401,486 | B1 | 6/2002 | Lee et al. | |

* cited by examiner

*Primary Examiner*—William C. Doerrler
(74) *Attorney, Agent, or Firm*—Hovey Williams LLP

(57) ABSTRACT

Improved methodology for starting up a LNG facility employing a refluxed heavies removal column. The improved methodology involves varying the temperature of the feed to the heavies removal column between start-up and normal operation. This allows a larger amount of the stream produced from the top of the heavies removal column during start-up to be used to more rapidly start up the LNG facility.

42 Claims, 2 Drawing Sheets

ENHANCED OPERATION OF LNG FACILITY EQUIPPED WITH REFLUXED HEAVIES REMOVAL COLUMN

BACKGROUND OF THE INVENTION

1. Field of the Invention

Figure 1:
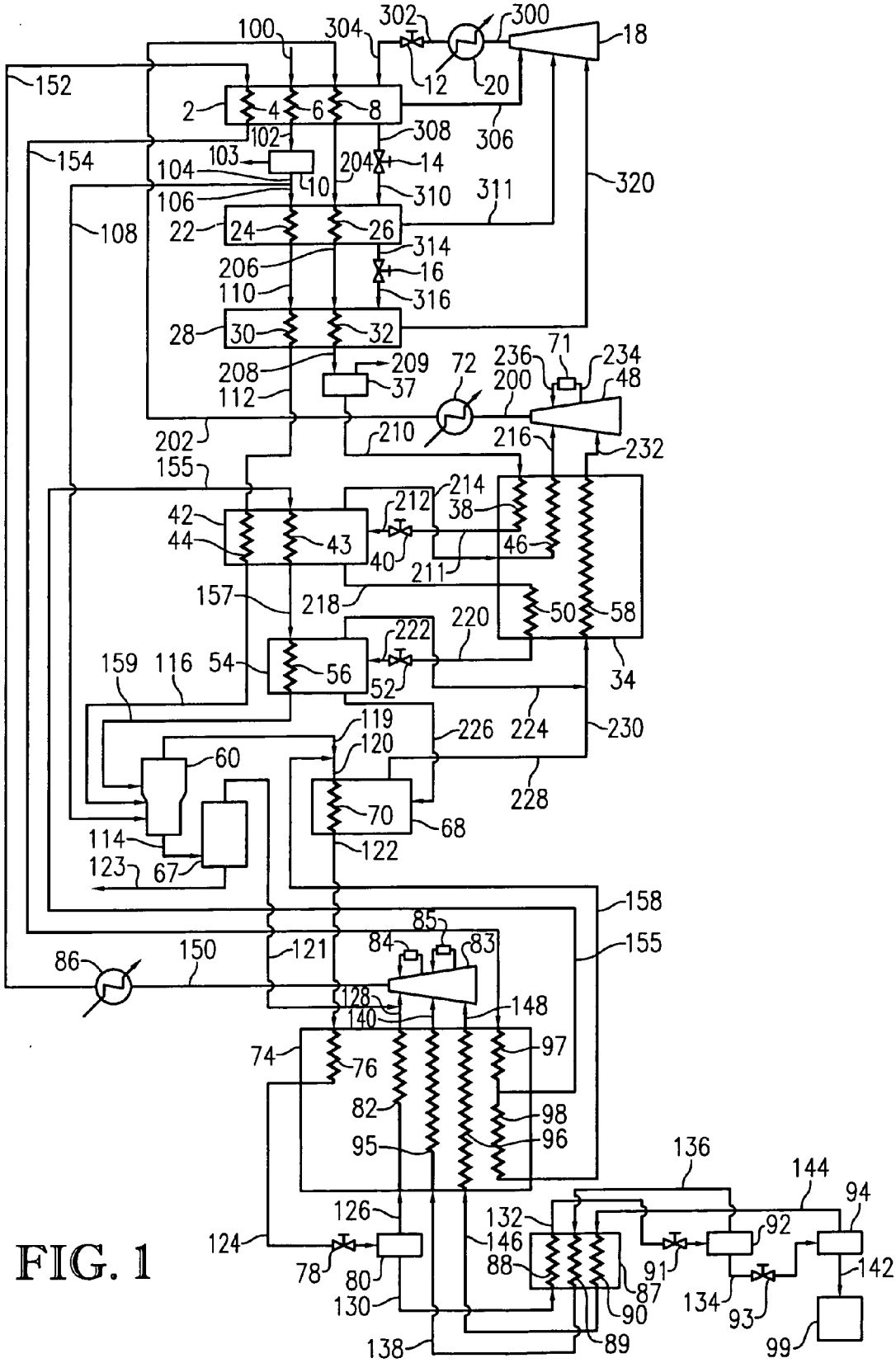

This invention relates to a method and apparatus for liquefying natural gas.

In another aspect, the invention concerns an improved methodology for starting up and operating a liquefied natural gas (LNG) facility employing a refluxed heavies removal column.

2. Description of the Prior Art

The cryogenic liquefaction of natural gas is routinely practiced as a means of converting natural gas into a more convenient form for transportation and storage. Such liquefaction reduces the volume of the natural gas by about 600-fold and results in a product which can be stored and transported at near atmospheric pressure.

Natural gas is frequently transported by pipeline from the supply source of supply to a distant market. It is desirable to operate the pipeline under a substantially constant and high load factor but often the deliverability or capacity of the pipeline will exceed demand while at other times the demand may exceed the deliverability of the pipeline.

In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems). A liquefaction methodology which is particularly applicable to the current invention employs an open methane cycle for the final refrigeration cycle wherein a pressurized LNG-bearing stream is flashed and the flash vapors (i.e., the flash gas stream(s)) are subsequently employed as cooling agents, recompressed, cooled, combined with the processed natural gas feed stream and liquefied thereby producing the pressurized LNG-bearing stream.

In most LNG facilities it is necessary to remove heavy components (e.g., benzene, toluene, xylene, and/or cyclohexane) from the processed natural gas stream in order to prevent freezing of the heavy components in downstream heat exchangers. It is known that refluxed heavies columns can provide significantly more effective and efficient heavies removal than non-refluxed columns. However, one drawback of using a refluxed heavies removal column in conventional LNG facilities has been the significant delay in starting up the LNG facilities caused by the refluxed heavies removal column. The main reason for this delay in starting up the LNG facility was that during start-up, the reflux stream to the heavies removal column originated from a lower outlet of the heavies removal column. During start-up, the bulk of the feed stream entering the heavies removal column exited an upper outlet of the heavies removal column. As a result, only a small portion of the feed stream entering the heavies removal column during start-up exited the lower outlet and was available for routing back to the column as the reflux stream. As start-up progressed, the quantity of the feed stream available for use as reflux gradually increased to its optimum designed flow rate over a period of many hours or even days. However, the refluxed heavies removal column could not effectively remove heavies from the processed natural gas stream until the reflux stream was flowing at its designed rate. Thus, conventional start-up of an LNG facility employing a refluxed heavies removal column took many hours or even days.

A further disadvantage of conventional LNG plant start-up procedures was that the processed natural gas stream exiting the upper portion of the refluxed heavies removal column was simply flared because the elevated heavies concentration of this stream would freeze in downstream heat exchangers. Thus, because the bulk of the processed natural gas stream entering the refluxed heavies removal column during start-up exited the upper portion of the column and was subsequently flared, conventional start-up procedures for an LNG facility employing a refluxed heavies removal column wasted a significant portion of the processed natural gas stream.

OBJECTS AND SUMMARY OF THE INVENTION

It is, therefore, an object of the present invention to provide a faster start-up procedure for a LNG facility employing a refluxed heavies removal column.

A further object of the invention is to provide a more efficient start-up procedure for a LNG facility employing a refluxed heavies removal column, wherein the start-up procedure does not waste (e.g., flare) a significant portion of the processed natural gas stream.

It should be understood that the above objects are exemplary and need not all be accomplished by the invention claimed herein. Other objects and advantages of the invention will be apparent from the written description and drawings.

Accordingly, one aspect of the present invention concerns a method of operating a liquefied natural gas facility comprising the steps of: (a) operating a heavies removal column in a start-up mode, with the start-up mode including separating a predominantly methane stream having a first inlet temperature into a first heavies stream and a first lights stream; and (b) operating the heavies removal column in a normal mode, with the normal mode including separating the predominantly methane stream having a second inlet temperature warmer than the first inlet temperature into a second heavies stream and a second lights stream.

Another aspect of the present invention concerns a method of starting up a liquefied natural gas facility comprising the steps of: (a) introducing a first predominantly methane stream having a first vapor/liquid hydrocarbon separation point $C_{X(X+1)}$ into a heavies removal column; and (b) introducing a second predominantly methane stream having a second vapor/liquid hydrocarbon separation point $C_{Y(Y+1)}$ to the heavies removal column, wherein X and Y are integers representing the number of carbon atoms in the hydrocarbon molecules of the predominantly methane stream, wherein Y is at least 1 greater than X.

A further aspect of the present invention concerns a method of starting up a cascade-type liquefied natural gas facility employing a refluxed heavies removal column between two refrigeration cycles of the facility. The method comprises the steps of: (a) operating the refluxed heavies removal column in an initiating mode, the initiating mode including initiating the flow of a natural gas stream through a feed inlet of the refluxed heavies removal column and into the refluxed heavies column, the refluxed heavies removal column including a reflux inlet spaced from the feed inlet, the reflux inlet having substantially no hydrocarbon-containing fluids flowing therethrough and into the refluxed heavies removal column during the initiating mode; (b) subsequent to step (a), operating the refluxed heavies removal column in a start-up mode, the start-up mode including using the refluxed heavies removal column to separate the natural gas stream into a first heavies stream and a first lights stream, the start-up mode including discharging the first lights stream from the refluxed heavies removal column, the start-up mode including routing at least a portion of the discharged first lights stream to the reflux inlet; and (c) subsequent to step (b), operating the refluxed heavies removal column in a normal mode, the normal mode including using the refluxed heavies removal column to separate the natural gas stream into a second heavies stream and a second lights stream, the normal mode including discharging the second lights stream from the refluxed heavies removal column, and the normal mode including routing at least a portion of the discharged second lights stream to the reflux inlet.

BRIEF DESCRIPTION OF THE DRAWING FIGURES

Figure 2:
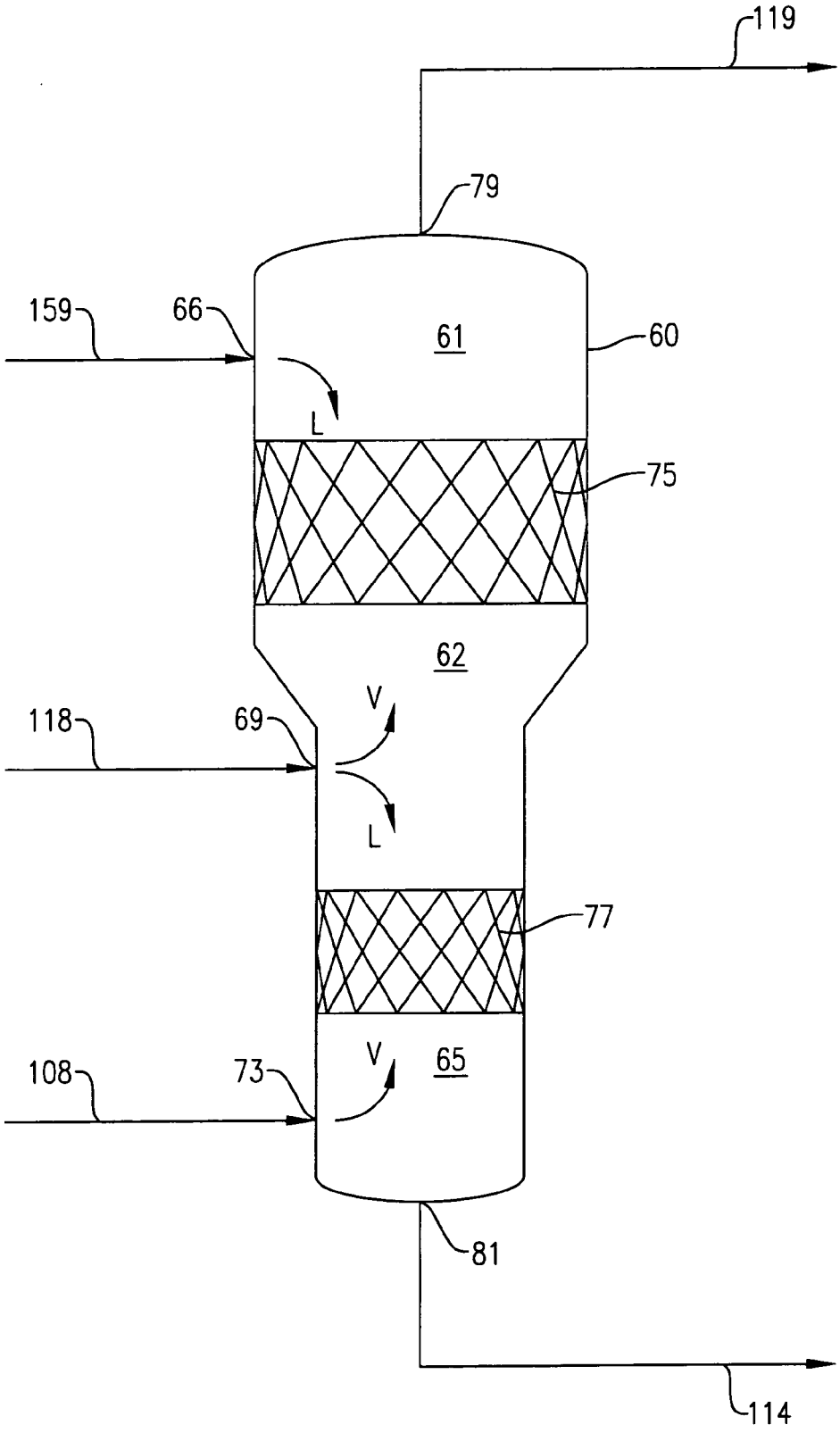

A preferred embodiment of the present invention is described in detail below with reference to the attached drawing figures, wherein:

FIG. 1 is a simplified flow diagram of a cascaded-type LNG facility within which the methodology of the present invention can be employed; and FIG. 2 is a schematic sectional view of a refluxed heavies removal column that can be controlled via the inventive methodology.

DETAILED DESCRIPTION OF THE PREFERRED EMBODIMENT

A cascaded refrigeration process uses one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures. The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment, and the proper selection of flow rates through such equipment so as to ensure that both flow rates and approach and outlet temperatures are compatible with the required heating/cooling duty.

As used herein, the term open-cycle cascaded refrigeration process refers to a cascaded refrigeration process comprising at least one closed refrigeration cycle and one open refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles. In the current invention, a predominately methane stream is employed as the refrigerant/cooling agent in the open cycle. This predominantly methane stream originates from the processed natural gas feed stream and can include the compressed open methane cycle gas streams. As used herein, the terms "predominantly", "primarily", "principally", and "in major portion", when used to describe the presence of a particular component of a fluid stream, shall mean that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

One of the most efficient and effective means of liquefying natural gas is via an optimized cascade-type operation in combination with expansion-type cooling. Such a liquefaction process involves the cascade-type cooling of a natural gas stream at an elevated pressure, (e.g., about 650 psia) by sequentially cooling the gas stream via passage through a multistage propane cycle, a multistage ethane or ethylene cycle, and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the terms "upstream" and "downstream" shall be used to describe the relative positions of various components of a natural gas liquefaction plant along the flow path of natural gas through the plant.

Various pretreatment steps provide a means for removing undesirable components, such as acid gases, mercaptan, mercury, and moisture from the natural gas feed stream delivered to the LNG facility. The composition of this gas stream may vary significantly. As used herein, a natural gas stream is any stream principally comprised of methane which originates in major portion from a natural gas feed stream, such feed stream for example containing at least 85 mole percent methane, with the balance being ethane, higher hydrocarbons, nitrogen, carbon dioxide, and a minor amount of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily known to one skilled in the art. Acid gases and to a lesser extent mercaptan are routinely removed via a sorption process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure generally greater than 500 psia, preferably about 500 psia to about 3000 psia, still more preferably about 500 psia to about 1000 psia, still yet more preferably about 600 psia to about 800 psia. The feed stream temperature is typically near ambient to slightly above ambient. A representative temperature range being 60° F. to 150° F.

As previously noted, the natural gas feed stream is cooled in a plurality of multistage cycles or steps (preferably three) by indirect heat exchange with a plurality of different refrigerants (preferably three). The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such relatively high boiling point refrigerant is preferably comprised in major portion of propane, propylene, or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such lower boiling point refrigerant is preferably comprised in major portion of ethane, ethylene, or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is preferably combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety, thereby producing a pressurized LNG-bearing stream. Generally, the process pressure at this location is only slightly lower than the pressure of the pretreated feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much of the $C_2$ and higher molecular weight hydrocarbons as possible from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications, and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_2$+ hydrocarbon stream or streams or the demethanized $C_2$+ hydrocarbon stream may be used as fuel or may be further processed, such as by fractionation in one or more fractionation zones to produce individual streams rich in specific chemical constituents (e.g., $C_2$, $C_3$, $C_4$, and $C_5$+).

The pressurized LNG-bearing stream is then further cooled in a third cycle or step referred to as the open methane cycle via contact in a main methane economizer with flash gases (i.e., flash gas streams) generated in this third cycle in a manner to be described later and via sequential expansion of the pressurized LNG-bearing stream to near atmospheric pressure. The flash gasses used as a refrigerant in the third refrigeration cycle are preferably comprised in major portion of methane, more preferably the flash gas refrigerant comprises at least 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is cooled via at least one, preferably two to four, and more preferably three expansions where each expansion employs an expander as a pressure reduction means. Suitable expanders include, for example, either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash expansion step will frequently more than off-set the higher capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

The liquefaction process described herein may use one of several types of cooling which include but are not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

The flow schematic and apparatus set forth in FIG. 1 represents a preferred embodiment of an LNG facility in which the methodology of the present invention can be employed. FIG. 2 represents a preferred embodiment of a refluxed heavies removal column for use with the methodology of the present invention. As used herein, the term "heavies removal column" shall denote a vessel operable to separate a heavy component(s) of a hydrocarbon-containing stream from a lighter component(s) of the hydrocarbon-containing stream. As used herein, the term "refluxed heavies removal column" shall denote a heavies removal column that employs a reflux stream to aid in separating heavy and light hydrocarbon components. Those skilled in the art will recognized that FIGS. 1 and 2 are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 1 and 2, the following numbering nomenclature was employed. Items numbered 1 through 99 are process vessels and equipment which are directly associated with the liquefaction process. Items numbered 100 through 199 correspond to flow lines or conduits which contain predominantly methane streams. Items numbered 200 through 299 correspond to flow lines or conduits which contain predominantly ethylene streams. Items numbered 300 through 399 correspond to flow lines or conduits which contain predominantly propane streams.

Referring to FIG. 1, during normal operation of the LNG facility, gaseous propane is compressed in a multistage (preferably three-stage) compressor 18 driven by a gas turbine driver (not illustrated). The three stages of compression preferably exist in a single unit although each stage of compression may be a separate unit and the units mechanically coupled to be driven by a single driver. Upon compression, the compressed propane is passed through conduit 300 to a cooler 20 where it is cooled and liquefied. A representative pressure and temperature of the liquefied propane refrigerant prior to flashing is about 100° F. and about 190 psia. The stream from cooler 20 is passed through conduit 302 to a pressure reduction means, illustrated as expansion valve 12, wherein the pressure of the liquefied propane is reduced, thereby evaporating or flashing a portion thereof. The resulting two-phase product then flows through conduit 304 into a high-stage propane chiller 2 wherein gaseous methane refrigerant introduced via conduit 152, natural gas feed introduced via conduit 100, and gaseous ethylene refrigerant introduced via conduit 202 are respectively cooled via indirect heat exchange means 4, 6, and 8, thereby producing cooled gas streams respectively produced via conduits 154, 102, and 204. The gas in conduit 154 is fed to a main methane economizer 74, which will be discussed in greater detail in a subsequent section, and wherein the stream is cooled via indirect heat exchange means 97. A portion of the stream cooled in heat exchange means 97 is removed from methane economizer 74 via conduit 155 and subsequently used, after further cooling, as a reflux stream in a heavies removal column 60, as discussed in greater detail below with reference to FIG. 2. The portion of the cooled stream from heat exchange means 97 that is not removed for use as a reflux stream is further cooled in indirect heat exchange means 98. The resulting cooled methane recycle stream produced via conduit 158 is then combined in conduit 120 with the heavies depleted (i.e., light-hydrocarbon rich) vapor stream from heavies removal column 60 and fed to an ethylene condenser 68.

The propane gas from chiller 2 is returned to compressor 18 through conduit 306. This gas is fed to the high-stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to an intermediate stage propane chiller 22 through conduit 310, thereby providing a coolant for chiller 22. The cooled feed gas stream from chiller 2 flows via conduit 102 to a knock-out vessel 10 wherein gas and liquid phases are separated. The liquid phase, which is rich in $C_3$+ components, is removed via conduit 103. The gaseous phase is removed via conduit 104 and then split into two separate streams which are conveyed via conduits 106 and 108. The stream in conduit 106 is fed to propane chiller 22. The stream in conduit 108 is employed as a stripping gas in refluxed heavies removal column 60 to aid in the removal of heavy hydrocarbon components from the processed natural gas stream, as discussed in more detail below with reference to FIG. 2. Ethylene refrigerant from chiller 2 is introduced to chiller 22 via conduit 204. In chiller 22, the feed gas stream, also referred to herein as a methane-rich stream, and the ethylene refrigerant streams are respectively cooled via indirect heat transfer means 24 and 26, thereby producing cooled methane-rich and ethylene refrigerant streams via conduits 110 and 206. The thus evaporated portion of the propane refrigerant is separated and passed through conduit 311 to the intermediate-stage inlet of compressor 18. Liquid propane refrigerant from chiller 22 is removed via conduit 314, flashed across a pressure reduction means, illustrated as expansion valve 16, and then fed to a low-stage propane chiller/condenser 28 via conduit 316.

As illustrated in FIG. 1, the methane-rich stream flows from intermediate-stage propane chiller 22 to the low-stage propane chiller/condenser 28 via conduit 110. In chiller 28, the stream is cooled via indirect heat exchange means 30. In a like manner, the ethylene refrigerant stream flows from the intermediate-stage propane chiller 22 to low-stage propane chiller/condenser 28 via conduit 206. In the latter, the ethylene refrigerant is totally condensed or condensed in nearly its entirety via indirect heat exchange means 32. The vaporized propane is removed from low-stage propane chiller/condenser 28 and returned to the low-stage inlet of compressor 18 via conduit 320.

As illustrated in FIG. 1, the methane-rich stream exiting low-stage propane chiller 28 is introduced to high-stage ethylene chiller 42 via conduit 112. Ethylene refrigerant exits low-stage propane chiller 28 via conduit 208 and is preferably fed to a separation vessel 37 wherein light components are removed via conduit 209 and condensed ethylene is removed via conduit 210. The ethylene refrigerant at this location in the process is generally at a temperature of about −24° F. and a pressure of about 285 psia. The ethylene refrigerant then flows to an ethylene economizer 34 wherein it is cooled via indirect heat exchange means 38, removed via conduit 211, and passed to a pressure reduction means, illustrated as an expansion valve 40, whereupon the refrigerant is flashed to a preselected temperature and pressure and fed to high-stage ethylene chiller 42 via conduit 212. Vapor is removed from chiller 42 via conduit 214 and routed to ethylene economizer 34 wherein the vapor functions as a coolant via indirect heat exchange means 46. The ethylene vapor is then removed from ethylene economizer 34 via conduit 216 and feed to the high-stage inlet of ethylene compressor 48. The ethylene refrigerant which is not vaporized in high-stage ethylene chiller 42 is removed via conduit 218 and returned to ethylene economizer 34 for further cooling via indirect heat exchange means 50, removed from ethylene economizer via conduit 220, and flashed in a pressure reduction means, illustrated as expansion valve 52, whereupon the resulting two-phase product is introduced into a low-stage ethylene chiller 54 via conduit 222.

After cooling in indirect heat exchange means 44, the methane-rich stream is removed from high-stage ethylene chiller 42 via conduit 116. The stream in conduit 116 is then carried to a feed inlet of heavies removal column 60 wherein heavy hydrocarbon components are removed from the methane-rich stream, as described in further detail below with reference to FIG. 2. A heavies-rich liquid stream containing a significant concentration of $C_4$+ hydrocarbons, such as benzene, toluene, xylene, cyclohexane, other aromatics, and/or heavier hydrocarbon components, is removed from the bottom of heavies removal column 60 via conduit 114. The heavies-rich stream in conduit 114 is subsequently separated into liquid and vapor portions or preferably is flashed or fractionated in vessel 67. In either case, a second heavies-rich liquid stream is produced via conduit 123 and a second methane-rich vapor stream is produced via conduit 121. In the preferred embodiment, which is illustrated in FIG. 1, the stream in conduit 121 is subsequently combined with a second stream delivered via conduit 128, and the combined stream fed to the high-stage inlet port of the methane compressor 83. High-stage ethylene chiller 42 also includes an indirect heat exchanger means 43 which receives and cools the stream withdrawn from methane economizer 74 via conduit 155, as discussed above. The resulting cooled stream from indirect heat exchanger means 43 is conducted via conduit 157 to low-stage ethylene chiller 54. In low-stage ethylene chiller 54 the stream from conduit 157 is cooled via indirect heat exchange means 56. After cooling in indirect heat exchange means 56, the stream exits low-stage ethylene chiller 54 and is carried via conduit 159 to a reflux inlet of heavies removal column 60 where it is employed as a reflux stream.

As previously noted, the gas in conduit 154 is fed to main methane economizer 74 wherein the stream is cooled via indirect heat exchange means 97. A portion of the cooled stream from heat exchange means 97 is then further cooled in indirect heat exchange means 98. The resulting cooled stream is removed from methane economizer 74 via conduit 158 and is thereafter combined with the heavies-depleted vapor stream exiting the top of heavies removal column 60, delivered via conduit 5,119, and 120, and fed to a low-stage ethylene condenser 68. In low-stage ethylene condenser 68, this stream is cooled and condensed via indirect heat exchange means 70 with the liquid effluent from low-stage ethylene chiller 54 which is routed to low-stage ethylene condenser 68 via conduit 226. The condensed methane-rich product from low-stage condenser 68 is produced via conduit 122. The vapor from low-stage ethylene chiller 54, withdrawn via conduit 224, and low-stage ethylene condenser 68, withdrawn via conduit 228, are combined and routed, via conduit 230, to ethylene economizer 34 wherein the vapors function as a coolant via indirect heat exchange means 58. The stream is then routed via conduit 232 from ethylene economizer 34 to the low-stage inlet of ethylene compressor 48.

As noted in FIG. 1, the compressor effluent from vapor introduced via the low-stage side of ethylene compressor 48 is removed via conduit 234, cooled via inter-stage cooler 71, and returned to compressor 48 via conduit 236 for injection with the high-stage stream present in conduit 216. Preferably, the two-stages are a single module although they may each be a separate module and the modules mechanically coupled to a common driver. The compressed ethylene product from compressor 48 is routed to a downstream cooler 72 via conduit 200. The product from cooler 72 flows via conduit 202 and is introduced, as previously discussed, to high-stage propane chiller 2.

The pressurized LNG-bearing stream, preferably a liquid stream in its entirety, in conduit 122 is preferably at a temperature in the range of from about −200 to about −50° F., more preferably in the range of from about −175 to about −100° F., most preferably in the range of from −150 to −125° F. The pressure of the stream in conduit 122 is preferably in the range of from about 500 to about 700 psia, most preferably in the range of from 550 to 725 psia. The stream in conduit 122 is directed to main methane economizer 74 wherein the stream is further cooled by indirect heat exchange means/heat exchanger pass 76 as hereinafter explained. It is preferred for main methane economizer 74 to include a plurality of heat exchanger passes which provide for the indirect exchange of heat between various predominantly methane streams in the economizer 74. Preferably, methane economizer 74 comprises one or more plate-fin heat exchangers. The cooled stream from heat exchanger pass 76 exits methane economizer 74 via conduit 124. It is preferred for the temperature of the stream in conduit 124 to be at least about 10° F. less than the temperature of the stream in conduit 122, more preferably at least about 25° F. less than the temperature of the stream in conduit 122. Most preferably, the temperature of the stream in conduit 124 is in the range of from about −200 to about −160° F. The pressure of the stream in conduit 124 is then reduced by a pressure reduction means, illustrated as expansion valve 78, which evaporates or flashes a portion of the gas stream thereby generating a two-phase stream. The two-phase stream from expansion valve 78 is then passed to high-stage methane flash drum 80 where it is separated into a flash gas stream discharged through conduit 126 and a liquid phase stream (i.e., pressurized LNG-bearing stream) discharged through conduit 130. The flash gas stream is then transferred to main methane economizer 74 via conduit 126 wherein the stream functions as a coolant in heat exchanger pass 82. The predominantly methane stream is warmed in heat exchanger pass 82, at least in part, by indirect heat exchange with the predominantly methane stream in heat exchanger pass 76. The warmed stream exits heat exchanger pass 82 and methane economizer 74 via conduit 128.

The liquid-phase stream exiting high-stage flash drum 80 via conduit 130 is passed through a second methane economizer 87 wherein the liquid is further cooled by downstream flash vapors via indirect heat exchange means 88. The cooled liquid exits second methane economizer 87 via conduit 132 and is expanded or flashed via pressure reduction means, illustrated as expansion valve 91, to further reduce the pressure and, at the same time, vaporize a second portion thereof. This two-phase stream is then passed to an intermediate-stage methane flash drum 92 where the stream is separated into a gas phase passing through conduit 136 and a liquid phase passing through conduit 134. The gas phase flows through conduit 136 to second methane economizer 87 wherein the vapor cools the liquid introduced to economizer 87 via conduit 130 via indirect heat exchanger means 89. Conduit 138 serves as a flow conduit between indirect heat exchange means 89 in second methane economizer 87 and heat exchanger pass 95 in main methane economizer 74. The warmed vapor stream from heat exchanger pass 95 exits main methane economizer 74 via conduit 140, is combined with the first nitrogen-reduced stream in conduit 406, and the combined stream is conducted to the intermediate-stage inlet of methane compressor 83.

The liquid phase exiting intermediate-stage flash drum 92 via conduit 134 is further reduced in pressure by passage through a pressure reduction means, illustrated as a expansion valve 93. Again, a third portion of the liquefied gas is evaporated or flashed. The two-phase stream from expansion valve 93 are passed to a final or low-stage flash drum 94. In flash drum 94, a vapor phase is separated and passed through conduit 144 to second methane economizer 87 wherein the vapor functions as a coolant via indirect heat exchange means 90, exits second methane economizer 87 via conduit 146, which is connected to the first methane economizer 74 wherein the vapor functions as a coolant via heat exchanger pass 96. The warmed vapor stream from heat exchanger pass 96 exits main methane economizer 74 via conduit 148, is combined with the second nitrogen-reduced stream in conduit 408, and the combined stream is conducted to the low-stage inlet of compressor 83.

The liquefied natural gas product from low-stage flash drum 94, which is at approximately atmospheric pressure, is passed through conduit 142 to a LNG storage tank 99. In accordance with conventional practice, the liquefied natural gas in storage tank 99 can be transported to a desired location (typically via an ocean-going LNG tanker). The LNG can then be vaporized at an onshore LNG terminal for transport in the gaseous state via conventional natural gas pipelines.

As shown in FIG. 1, the high, intermediate, and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 121 and 128 prior to the third-stage of compression. The compressed gas (i.e., compressed open methane cycle gas stream) is discharged from high stage methane compressor through conduit 150, is cooled in cooler 86, and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 which enters the main methane economizer 74 undergoes cooling in its entirety via flow through indirect heat exchange means 98. This cooled stream is then removed via conduit 158 and combined with the processed natural gas feed stream upstream of the first stage of ethylene cooling.

Referring now to FIG. 2, refluxed heavies column 60 generally includes an upper zone 61, a middle zone 62, and a lower zone 65. Upper zone 61 receives the reflux stream in conduit 159 via a reflux inlet 66. Middle zone 62 receives the processed natural gas stream in conduit 118 via a feed inlet 69. Lower zone 65 receives the stripping gas stream in conduit 108 via a stripping gas inlet 73. Upper zone 61 and middle zone 62 are separated by upper internal packing 75, while middle zone 62 and lower zone 65 are separated by lower internal packing 77. Internal packing 75,77 can be any conventional structure known in the art for enhancing contact between two countercurrent streams in a vessel. Refluxed heavies removal column 60 also includes an upper outlet 79 and a lower outlet 81.

In accordance with the present invention, heavies removal column 60 can be operated in three distinct modes: an initiating mode, a start-up mode, and a normal mode. The initiating mode involves initiating the flow of a hydrocarbon-containing stream into heavies removal column 60 via feed inlet 69. Immediately prior to the initiating mode, substantially no hydrocarbon-containing streams flow into or through heavies removal column 60. During the initiating mode, substantially no hydrocarbon-containing streams are introduced into heavies removal column 60 through reflux inlet 66 and stripping gas inlet 73.

The start-up mode of operation involves continuing the flow of the hydrocarbon-containing stream (e.g., processed natural gas stream) into heavies removal column 60 via feed inlet 69. During the start-up mode, the stream entering column 60 via feed inlet 69 is separated into a light vapor stream, which exits column 60 via upper outlet 79, and a heavy liquid stream, which exits column 60 via lower outlet 81. During the start-up mode, at least a portion of the light vapor stream exiting upper outlet 79 via conduit 119 is routed back to heavies removal column 60 and introduced into upper zone 61 of heavies removal column 60 via reflux inlet 66. Referring now to FIG. 2, during start-up, the routing of the light vapor stream in conduit 119 back to reflux inlet 66 of heavies removal column 60 takes place by initially routing the stream to the open-methane refrigeration cycle via conduit 120, heat exchange means 70, and conduit 122. The stream exits the open-methane cycle and is fed to methane compressor 83. From methane compressor 83 the stream is then routed back to heavies removal column 60 via the following conduits and components: conduit 150, cooler 86, conduit 152, heat exchange means 4, conduit 154, heat exchange means 97, conduit 155, heat exchange means 43, conduit 157, heat exchange means 56, and conduit 159. Referring to FIGS. 1 and 2, during the start-up mode, at least a portion of the heavy liquid stream exiting lower outlet 81 of heavies removal column 60 via conduit 114 is routed back to reflux inlet 66 of heavies removal column via the following conduits and components: vessel 67, conduit 121, conduit 128, methane compressor 83, conduit 150, cooler 86, conduit 152, heat exchange means 4, conduit 154, heat exchange means 97, conduit 155, heat exchange means 43, conduit 157, heat exchange means 56, and conduit 159.

Referring again to FIG. 2, during the normal mode of operation, the feed stream enters middle zone 62 of heavies removal column 60 via feed inlet 69, the reflux stream enters upper zone 61 of heavies removal column 60 via reflux inlet 66, and the stripping gas stream enters lower zone 65 of heavies removal column 60 via stripping gas inlet 73. During the normal mode, the downwardly flowing liquid reflux stream is contacted in upper internal packing 75 with the upwardly flowing vapor portion of the feed stream, while the downwardly flowing liquid portion of the feed stream is contacted in lower internal packing 77 with the upward flowing stripping gas. In this manner, heavies removal column 60 is operable to produce a heavies-depleted (i.e., lights-rich) stream via upper outlet 79 and a heavies-rich stream via lower outlet 81 during the normal mode. During the normal mode, the feed introduced into heavies removal column 60 via feed inlet 69 typically has a $C_5$+ concentration of at least 0.1 mole percent, a $C_4$ concentration of at least 2 mole percent, a benzene concentration of at least 4 ppmw (parts per million by weight), a cyclohexane concentration of at least 4 ppmw, and/or a combined concentration of xylene and toluene of at least 10 ppmw. When operating during the normal mode, the heavies-depleted stream exiting heavies removal column 60 via upper outlet 79 preferably has a lower concentration of $C_4$+ hydrocarbon components than the feed entering inlet 69, more preferably the heavies-depleted stream exiting upper outlet 79 has a $C_5$+ concentration of less than 0.1 mole percent, a $C_4$ concentration of less than 2 mole percent, a benzene concentration of less than 4 ppmw, a cyclohexane concentration of less than 4 ppmw, and a combined concentration of xylene and toluene of less than 10 ppmw. When operating during the normal mode, the heavies-rich stream exiting heavies removal column 60 via lower outlet 81 preferably has a higher concentration of $C_4$+ hydrocarbons than the feed entering feed inlet 69. During the normal mode, it is preferred for the stripping gas entering heavies removal column 60 via stripping gas inlet 66 to comprise a higher proportion of light hydrocarbons than the feed to feed inlet 69 of heavies removal column 60. More preferably the reflux stream entering reflux inlet 66 of heavies removal column 60 during the normal mode comprises at least about 90 mole percent methane, still more preferably at least about 95 mole percent methane, and most preferably at least 97 mole percent methane. When operating during the normal mode, it is preferred for the stripping gas entering heavies removal column 60 via stripping gas inlet 73 to have substantially the same composition as the feed stream entering heavies removal column 60 via feed inlet 69.

Referring to FIGS. 1 and 2, when the LNG facility illustrated in FIG. 1 is started up, the flow of the natural gas stream is initiated in conduit 100. The natural gas stream is then sequentially cooled via indirect heat transfer in heat exchange means 6,24,30, and 44. In accordance with one embodiment of the present invention, the propane and ethylene refrigeration cycles are controlled during start-up in a manner so that the cooled natural gas stream exiting heat exchange means 44 of high-stage ethylene chiller 42 and entering feed inlet 69 of heavies removal column 60 is a two-phase stream. Preferably, the two-phase stream entering feed inlet 69 of heavies removal column 60 during start-up includes a vapor phase that contains predominantly light hydrocarbon components and a liquid phase that contains predominantly heavy hydrocarbon components.

As used herein, the term "vapor/liquid hydrocarbon separation point" or simply "hydrocarbon separation point" shall be used to identify a point of separation between the vapor and liquid phases of a hydrocarbon-containing stream based on the number of carbon atoms in the hydrocarbon molecules of the phases. When the hydrocarbon separation point is represented by the formula $C_{X(X+1)}$ then a predominant molar portion of $C_X$-hydrocarbon molecules are present in the vapor phase while a predominant molar portion of $C_{(X+)}$+ hydrocarbon molecules are present in the liquid phase. For example, if the hydrocarbon separation point of a certain two-phase hydrocarbon-containing stream is $C_{4/5}$, then a predominant portion (i.e., more than 50 mole percent) of the $C_5$+ hydrocarbons are present in the liquid phase while a predominant molar portion of the $C_4$− hydrocarbons are present in the vapor phase. In other words, if the hydrocarbon separation point is $C_{4/5}$, the vapor phase would contain more than 50 mole percent of the $C_4$ hydrocarbons present in the two-phase stream, more than 50 mole percent of the $C_3$ hydrocarbons present in the two-phase stream, more than 50 mole percent of the $C_2$ hydrocarbons present in the two-phase stream, and more than 50 mole percent of the $C_1$ hydrocarbons present in the two-phase stream, while the liquid phase would contain more than 50 mole percent of the $C_5$, $C_6$, $C_7$, $C_8$ etc. hydrocarbons present in the two-phase stream.

The stream entering feed inlet 69 of heavies removal column 60 during the start-up mode preferably has a hydrocarbon separation point which can be represented as follows: $C_{X(X+1)}$, wherein X is an integer in the range of from 2 to 10. More preferably, X is in the range of from 2 to 6, still more preferably in the range of from 3 to 5, and most preferably X is 4. When the feed to inlet 69 of heavies removal column 60 has the above-described hydrocarbon separation point, it is ensured that a significant portion of the light hydrocarbon-containing vapor phase exits upper outlet 79 and a significant portion of the heavy hydrocarbon-containing liquid phase exits lower outlet 81 during start-up. The hydrocarbon separation point of the two-phase stream entering feed inlet 69 of heavies removal column 60 is controlled by controlling its temperature. As the temperature of the feed stream increases, the value of X increases. Conversely, as the temperature of the feed stream decreases, the value of X decreases. Preferably, the temperature of the stream entering feed inlet 69 of heavy removal column 60 during start-up is in the range of from about −100 to about −80° F., more preferably in the range of from about −100 to −90° F., most preferably in the range of from −97.5 to −92.5° F.

During the normal mode of operation, the stream entering feed inlet 69 of heavies removal column 60 preferably has a hydrocarbon separation point which can be represented as follows: $C_{Y(Y+1)}$, wherein Y is an integer in the range of from 2 to 10. More preferably, Y is in the range of from 4 to 8, still more preferably in the range of from 5 to 7, and most preferably Y is 6. Preferably, Y is at least 1 greater than X. Most preferably, Y is 2 greater than X. When the feed to inlet 69 of heavies removal column 60 has the above-described hydrocarbon separation point, optimal heavies removal can be achieved during the normal mode.

In order to switch from the start-up operational mode to the normal operational mode, the hydrocarbon separation point of the feed to heavies removal column 60 is increased. As mentioned above, the hydrocarbon separation point of the stream entering feed inlet 69 of heavies removal column 60 is controlled by controlling its temperature. Thus, in order to switch from the start-up mode to the normal mode, the temperature of the feed entering heavies removal column 60 via feed inlet 69 is increased. A preferred way of controlling the temperature of the feed entering heavies removal column 60 via feed inlet 69 is to control the speed of ethylene compressor 48. Ethylene compressor 48 is preferably a multi-stage axial or centrifugal compressor, wherein the pressure differential between the inlet and outlet of the compressor can be increased by increasing the speed of the compressor and decreased by decreasing the speed of the compressor. It is preferred for the speed (and pressure differential) of ethylene compressor 48 to be greater during the start-up mode than during the normal mode. This provides for more chilling of the processed natural gas stream in indirect heat exchange means 44 of high-stage ethylene chiller 42 during start-up than during normal operation. Thus, the temperature of the feed entering heavies removal column 60 via conduit 116 is lower during start-up than during normal operation. In order to shift from the start-up mode to the normal mode, it is preferred for the speed of ethylene compressor 48 to be reduced, thereby changing the temperature and hydrocarbon separation point of the feed to heavies removal column 60 as described herein. Preferably, the temperature of the feed entering heavies removal column 60 via feed inlet 69 during the normal mode is at least about 2° F. warmer than the feed entering heavies removal column 60 via feed inlet 69 during the start-up mode, more preferably at least 4° F. warmer, and most preferably in the range of from 4 to 12° F. warmer. Preferably, the temperature of the stream entering feed inlet 69 of heavies removal column 60 during the normal mode is in the range of from about −100 to about −75° F., more preferably in the range of from about −95 to about −80° F., most preferably in the range of from −92.5 to −85° F.

During the normal operational mode, it is preferred for the temperature of the reflux stream entering heavies removal column 60 via reflux inlet 66 to be cooler than the temperature of the feed stream entering heavies removal column 60 via feed inlet 69, more preferably at least about 5° F. cooler, still more preferably at least about 15° F. cooler, and most preferably at least 35° F. cooler. Preferably, the temperature of the reflux stream entering reflux inlet 66 of heavies removal column 60 during the normal mode is in the range of from about −160 to about −100° F., more preferably in the range of from about −145 to about −120° F., most preferably in the range of from −138 to −125° F. During the normal operational mode, it is preferred for the temperature of the stripping gas stream entering heavies removal column 60 via stripping gas inlet 73 to be warmer than the temperature of the feed stream entering heavies removal column 60 via feed inlet 69, more preferably at least about 5° F. warmer, still more preferably at least about 20° F. warmer, and most preferably at least 40° F. warmer. Preferably, the temperature of the stripping gas stream entering stripping gas inlet 66 of heavies removal column 60 during the normal mode is in the range of from about −75 to about −0° F., more preferably in the range of from about −60 to about −15° F., most preferably in the range of from −40 to −30° F.

The above-described methodology allows a LNG facility employing a refluxed heavies removal column to be started up faster than conventional methods because during start-up, a significantly greater amount of the separated natural gas stream exiting the heavies removal can be used to help start-up downstream equipment (e.g., the open methane cooling cycle). In addition, the present invention also allows the LNG facility to be started up more rapidly because an adequate reflux stream to the heavies removal column is established much more rapidly than under conventional methods.

In one embodiment of the present invention, the LNG production systems illustrated in FIGS. 1 and 2 are simulated on a computer using conventional process simulation software. Examples of suitable simulation software include HYSYS™ from Hyprotech, Aspen Plus® from Aspen Technology, Inc., and PRO/II® from Simulation Sciences Inc.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method of operating a liquefied natural gas facility, said method comprising the steps of:

(a) operating a heavies removal column in a start-up mode, said start-up mode including separating a predominantly methane stream into a first heavies stream and a first lights stream, said predominantly methane stream having a first inlet temperature during the start-up mode; and (b) operating the heavies removal column in a normal mode, said normal mode including separating the predominantly methane stream into a second heavies stream and a second lights stream, said predominantly methane stream having a second inlet temperature during the normal mode, said second inlet temperature being warmer than the first inlet temperature.

2. The operating method of claim 1, said second inlet temperature being at least 2° F. warmer than said first inlet temperature.

3. The operating method of claim 1, said second inlet temperature being at least 4° F. warmer than said first inlet temperature.

4. The operating method of claim 1, said second inlet temperature being in the range of from about 4 to about 12° F. greater than the first inlet temperature.

5. The operating method of claim 1, said predominantly methane stream entering the heavies removal column during the start-up mode having a first vapor/liquid hydrocarbon separation point $C_{X(X+1)}$, said predominantly methane stream entering the heavies removal column during the normal mode having a second vapor/liquid hydrocarbon separation point $C_{Y/(Y+1)}$, wherein X and Y are integers representing the number of carbon atoms in the hydrocarbon molecules of the respective predominantly methane stream, wherein Y is at least 1 greater than X.

6. The operating method of claim 5, wherein X and Y are in the range of from 2 to 10.

7. The operating method of claim 5, wherein X is in the range of from 3 to 5 and Y is in the range of from 5 to 7.

8. The operating method of claim 5, wherein X is 4 and Y is 6.

9. The operating method of claim 1, said heavies removal column being a refluxed heavies removal column.

10. The operating method of claim 9, said heavies removal column including a feed inlet, a reflux inlet, and a stripping gas inlet, said reflux inlet being spaced from and located above the feed and stripping gas inlets, said feed inlet being spaced from and located above the stripping gas inlet.

11. The operating method of claim 10, said heavies removal column including first and second sets of internal packing, said first set of internal packing being vertically disposed between the feed inlet and the stripping gas inlet, said second set of internal packing being vertically disposed between the feed inlet and the reflux inlet.

12. The operating method of claim 10; and (c) prior to step (a), operating the heavies removal column in an initiating mode, said initiating mode including initiating the flow of the predominantly methane stream through the feed inlet and into the heavies removal column.

13. The operating method of claim 12, said initiating mode including causing substantially no hydrocarbon-containing fluids to flow through the reflux inlet and into the heavies removal column.

14. The operating method of claim 10, said start-up mode including discharging the first light stream from the heavies removal column and routing at least a portion of the discharged first lights stream to the reflux inlet.

15. The operating method of claim 14, said normal mode including discharging the second lights stream from the heavies removal column and routing at least a portion of the discharged second lights stream to the reflux inlet.

16. The operating method of claim 1, and (d) switching from the start-up mode to the normal mode by increasing the temperature of the predominantly methane stream entering the heavies removal column.

17. The operating method of claim 16, and (e) upstream of the heavies removal column, cooling the natural gas stream in a first refrigeration cycle employing a first refrigerant comprising predominantly propane, propylene, ethane, ethylene, or carbon dioxide.

18. The operating method of claim 17, step (d) including adjusting an operating parameter of the first refrigeration cycle to thereby cause an increase in the temperature of the natural gas stream entering the heavies removal column.

19. The operating method of claim 18, said first refrigeration cycle including a first compressor for increasing the pressure of the first refrigerant, step (d) including adjusting the first compressor to thereby cause a decrease in the differential pressure of the first refrigerant across the first compressor.

20. The operating method of claim 19, said first compressor being an axial or centrifugal compressor, step (d) including slowing down the rotation of the first compressor.

21. The operating method of claim 18, said first refrigerant comprising predominantly ethane or ethylene.

22. The operating method of claim 21; and (f) upstream of the first refrigeration cycle, cooling the predominantly methane stream in a second refrigeration cycle employing a second refrigerant comprising predominantly propane or propylene.

23. The operating method of claim 21; and (g) downstream of the heavies removal column and during the normal mode, cooling at least a portion of the second lights stream in a third refrigeration cycle employing a third refrigerant comprising predominantly methane.

24. The operating method of claim 23, said third refrigeration cycle being an open methane cycle.

25. The operating method of claim 1, said liquefied natural gas facility employing cascade-type cooling via a plurality of refrigeration cycles employing different refrigerants.

26. The operating method of claim 1; and (h) vaporizing liquefied natural gas produced by the liquefied natural gas facility during the normal mode.

27. A method of starting up a cascade-type liquefied natural gas facility employing a refluxed heavies removal column between two refrigeration cycles of the facility, said method comprising the steps of:

(a) operating the refluxed heavies removal column in an initiating mode, said initiating mode including initiating the flow of a natural gas stream through a feed inlet of the refluxed heavies removal column and into the refluxed heavies column, said refluxed heavies removal column including a reflux inlet spaced from the feed inlet, said reflux inlet having substantially no hydrocarbon-containing fluids flowing therethrough and into the refluxed heavies removal column during operation in the initiating mode;

(b) subsequent to step (a), operating the refluxed heavies removal column in a start-up mode, said start-up mode including using the refluxed heavies removal column to separate the natural gas stream into a first heavies stream and a first lights stream, said start-up mode including discharging the first lights stream from the refluxed heavies removal column, said start-up mode including routing at least a portion of the discharged first lights stream to the reflux inlet; and (c) subsequent to step (b), operating the refluxed heavies removal column in a normal mode, said normal mode including using the refluxed heavies removal column to separate the natural gas stream into a second heavies stream and a second lights stream, said normal mode including discharging the second lights stream from the refluxed heavies removal column, said normal mode including routing at least a portion of the discharged second lights stream to the reflux inlet.

28. The start-up method of claim 27, said natural gas stream entering the refluxed heavies removal column at a first inlet temperature during the start-up mode, said natural gas stream entering the refluxed heavies removal column at a second inlet temperature during the normal mode, said second inlet temperature being at least 2° F. greater than the first inlet temperature.

29. The start-up method of claim 28, said second inlet temperature being in the range of from about 4 to about 12° F. greater than the first inlet temperature.

30. The start-up method of claim 27, said natural gas stream having a first vapor/liquid hydrocarbon separation point $C_{X(X+1)}$ during the start-up mode, said natural gas stream having a second vapor/liquid hydrocarbon separation point $C_{Y(Y+1)}$ during the normal mode, wherein X and Y are integers representing the number of carbon atoms in the hydrocarbon molecules of the respective natural gas stream, wherein X and Y are in the range of from 2 to 10, wherein X is at least 1 greater than Y.

31. The start-up method of claim 30, wherein X is in the range of from 3 to 5 and Y is in the range of from 5 to 7.

32. The start-up method of claim 30, wherein Y is at least 2 greater than X.

33. The start-up method of claim 30, wherein X is 4 and Y is 6.

34. The start-up method of claim 27, said refluxed heavies removal column including a stripping gas inlet, said refluxed inlet being spaced from and located above the feed and stripping gas inlets, said feed inlet being spaced from and located above the stripping gas inlet.

35. The start-up method of claim 34, said heavies removal column including first and second sets of internal packing, said first set of internal packing being vertically disposed between the feed inlet and the stripping gas inlet, said second set of internal packing being vertically disposed between the feed inlet and the reflux inlet.

36. The start-up method of claim 27; and (d) upstream of the refluxed heavies removal column, cooling the natural gas stream in a first refrigeration cycle employing a first compressor to compress a first refrigerant.

37. The start-up method of claim 36; and (e) switching from the start-up mode to the normal mode by adjusting the differential pressure of the first refrigerant across the first compressor.

38. The start-up method of claim 37, step (e) including decreasing the differential pressure of the first refrigerant across the first compressor.

39. The start-up method of claim 37, said first refrigerant comprising predominantly propane, propylene, ethane, ethylene, or carbon dioxide.

40. The start-up method of claim 36; and (f) downstream of the refluxed heavies removal column, cooling the natural gas stream in a second refrigeration cycle employing a second refrigerant comprising predominantly methane.

41. The start-up method of claim 40; and (g) upstream of the first refrigeration cycle, cooling the natural gas stream in a third refrigeration cycle employing a third refrigerant comprising predominantly propane or propylene, said first refrigerant comprising predominantly ethane or ethylene.

42. The start-up method of claim 27; and (h) vaporizing liquefied natural gas produced by the liquefied natural gas facility during the normal mode.

* * * * *

UNITED STATES PATENT AND TRADEMARK OFFICE

CERTIFICATE OF CORRECTION

PATENT NO. : 6,925,837 B2
DATED : August 9, 2005
INVENTOR(S) : Anthony P. Eaton

It is certified that error appears in the above-identified patent and that said Letters Patent is hereby corrected as shown below:

Column 9,
Line 38, delete “feed” and insert -- fed --.

Column 14,
Line 22, after “Cx(x+1)”, insert -- , --.

Column 17,
Line 4, please enlarge font size for equation.

Signed and Sealed this

Twenty-seventh Day of December, 2005

JON W. DUDAS
*Director of the United States Patent and Trademark Office*